US010774613B2

(12) United States Patent
Gaspard et al.

(10) Patent No.: US 10,774,613 B2
(45) Date of Patent: Sep. 15, 2020

(54) TIEBACK CEMENTING PLUG SYSTEM

(71) Applicant: Weatherford Technology Holdings, LLC, Houston, TX (US)

(72) Inventors: Gregory Gerard Gaspard, Tylertown, MS (US); Douglas Brian Farley, Missouri City, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/908,419

(22) Filed: Feb. 28, 2018

(65) Prior Publication Data

US 2018/0187511 A1 Jul. 5, 2018

Related U.S. Application Data

(63) Continuation of application No. 15/790,517, filed on Oct. 23, 2017, now abandoned, which is a (Continued)

(51) Int. Cl.
*E21B 17/00* (2006.01)
*E21B 33/12* (2006.01)
(Continued)

(52) U.S. Cl.
CPC ..... *E21B 33/143* (2013.01); *E21B 17/00* (2013.01); *E21B 33/12* (2013.01); *E21B 33/16* (2013.01); *E21B 34/06* (2013.01)

(58) Field of Classification Search
CPC ..... E21B 17/00; E21B 33/12; E21B 33/143; E21B 33/16; E21B 34/06
See application file for complete search history.

(56) References Cited

U.S. PATENT DOCUMENTS 3,957,114 A * 5/1976 Streich ..... E21B 21/10 166/285
4,501,330 A 2/1985 Garcia
(Continued)

FOREIGN PATENT DOCUMENTS

EP 0869257 A2 10/1998
WO 1994027026 A1 11/1994

OTHER PUBLICATIONS

PCT International Search Report and Written Opinion dated Aug. 5, 2015, for International Application No. PCT/US2015/019092.
(Continued)

*Primary Examiner* — Matthew R Buck
(74) *Attorney, Agent, or Firm* — Patterson + Sheridan, LLP

(57) ABSTRACT

A method for casing a subsea wellbore includes running a tieback casing string into the subsea wellbore using a workstring including first, second, and third wiper plugs. The method further includes: launching a first release plug or tag into the workstring; pumping cement slurry into the workstring, thereby driving the first release plug or tag along the workstring; after pumping the cement slurry, launching a second release plug or tag into the workstring; and pumping chaser fluid into the workstring, thereby driving the release plugs or tags and cement slurry through the workstring. The release plugs or tags engage and release the respective wiper plugs from the workstring. The first wiper plug or release plug ruptures, thereby allowing the cement slurry to flow therethrough. The method further includes: stabbing the tieback casing string into a liner string; and retrieving the workstring, the workstring still including the third wiper plug.

19 Claims, 10 Drawing Sheets

Related U.S. Application Data continuation of application No. 14/639,309, filed on Mar. 5, 2015, now Pat. No. 9,797,220.

(60) Provisional application No. 61/948,930, filed on Mar. 6, 2014.

(51) Int. Cl.

| | |
|---|---|
| ***E21B 33/14*** | (2006.01) |
| ***E21B 33/16*** | (2006.01) |
| ***E21B 34/06*** | (2006.01) |

(56) References Cited

U.S. PATENT DOCUMENTS 4,624,312 A * 11/1986 McMullin ..... E21B 33/05 166/153
4,712,619 A * 12/1987 Stepp ..... E21B 21/10 137/515
4,760,882 A * 8/1988 Novak ..... C09K 8/24 166/295
4,809,776 A * 3/1989 Bradley ..... E21B 33/05 166/153
4,961,465 A * 10/1990 Brandell ..... E21B 33/124 166/184
5,392,852 A * 2/1995 Laurel ..... E21B 33/16 166/153
5,443,122 A 8/1995 Brisco
5,450,903 A 9/1995 Budde
5,501,280 A * 3/1996 Brisco ..... E21B 21/10 166/324
5,553,667 A 9/1996 Budde et al.
5,556,667 A 9/1996 Teranishi et al.
5,566,772 A * 10/1996 Coone ..... E21B 17/07 166/242.7
5,762,139 A * 6/1998 Sullaway ..... E21B 33/16 166/155
5,787,979 A 8/1998 Giroux et al.
5,813,457 A 9/1998 Giroux et al.
5,829,523 A * 11/1998 North ..... E21B 33/16 166/250.14
5,890,537 A 4/1999 Lavaure et al.
5,950,725 A 9/1999 Rondeau et al.
6,009,944 A 1/2000 Gudmestad
6,056,053 A * 5/2000 Giroux ..... E21B 21/10 166/155
6,082,451 A 7/2000 Giroux et al.
6,206,094 B1 3/2001 Smith, Jr.
6,244,342 B1 * 6/2001 Sullaway ..... E21B 21/10 166/285
6,244,350 B1 6/2001 Gudmestad et al.
6,309,002 B1 10/2001 Bouligny
6,311,771 B1 11/2001 Gudmestad et al.
6,419,015 B1 * 7/2002 Budde ..... E21B 33/05 166/177.4
6,799,638 B2 10/2004 Butterfield, Jr.
6,802,372 B2 10/2004 Budde
7,182,135 B2 2/2007 Szarka
7,857,052 B2 * 12/2010 Giroux ..... E21B 7/20 166/289
8,201,634 B2 * 6/2012 Laurel ..... E21B 33/16 166/153
8,316,931 B2 11/2012 Rondeau et al.
8,327,930 B2 12/2012 Rondeau
8,327,937 B2 12/2012 Giem et al.
8,789,582 B2 7/2014 Rondeau et al.
9,200,499 B2 12/2015 Hall et al.
9,291,007 B2 * 3/2016 Darbe ..... E21B 33/14
9,797,220 B2 * 10/2017 Gaspard ..... E21B 33/143
2005/0103492 A1 5/2005 Szarka
2007/0261850 A1 * 11/2007 Giroux ..... E21B 7/20 166/291
2010/0294503 A1 11/2010 Laurel et al.
2013/0112410 A1 5/2013 Szarka et al.
2015/0101801 A1 4/2015 Budde

OTHER PUBLICATIONS

MacEachern, Douglas P. et al., "Advances in Tieback Cementing", Society of Petroleum Engineers, Feb. 2003, pp. 1-9.
European Office Action dated Oct. 19, 2017 for Application No. 15 711 008.1.
European Office Action dated Jul. 12, 2017 for Application No. 15 711 008.1.
Tommy M. Warren, Per Angman, and Bruce Houtchens; Casing Drilling Application Design Considerations; IADC/SPE 59179; IADC/SPE Drilling Conference; Feb. 23-25, 2000; 13 pages.
Weatherford Leading by Example, World's First Drilling with Casing Operation From a Floating Drilling Unit; Weatherford; Sep. 2003; 2 pages.
Greg Galloway; Rotary Drilling with Casing, Afield Proven Method of Reducing Wellbore Construction Cost, WOCD-0306-02; World Oil Casing Drilling Technical Conference; Mar. 6-7, 2003; 7 Pages.
Dave McKay, Greg Galloway, and Ken Dalrymple; New Developments in the Technolgy of Drilling with Casing: Utilizing a Displaceable DrillShoe Tool, WOCD-0306-05; World Oil Casing Drilling Technical Conference; Mar. 6-7, 2003; 11 Pages.
International Preliminary Report on Patentability in related application PCT/US2015/019092 dated Sep. 15, 2016.

* cited by examiner

TIEBACK CEMENTING PLUG SYSTEM

CROSS-REFERENCE TO RELATED APPLICATIONS

This application is a continuation of co-pending U.S. patent application Ser. No. 15/790,517, filed Oct. 23, 2017, which is a continuation of U.S. patent application Ser. No. 14/639,309, filed Mar. 5, 2015, which claims benefit of U.S. Provisional Patent Application Ser. No. 61/948,930, filed Mar. 6, 2014. Each of the aforementioned patent applications is incorporated by reference.

BACKGROUND OF THE DISCLOSURE

Field of the Disclosure

The present disclosure generally relates to a plug system for cementing a tieback casing string.

Description of the Related Art

Tieback casing strings are utilized to extend a production liner to a wellhead. Installation of a liner/tieback combination offers several advantages over a continuous casing, including delaying of expenses for uncertain or high risk well exploration, testing of isolation between the liner annulus and the open hole section, and a reduction of load-bearing requirements for derricks.

Many tieback strings are installed and cemented just before installation of completion equipment. However, issues with the cementing operation may necessitate removal of the tieback string and cement to correct the issues, a process which can be both expensive and time consuming.

Therefore, there is a need for an improved process for cementing a tieback casing string.

SUMMARY OF THE DISCLOSURE

The present disclosure generally relates to a plug system for cementing a tieback casing string. In one embodiment, a method for casing a subsea wellbore includes running a tieback casing string into the subsea wellbore using a workstring. The workstring includes a first wiper plug, a second wiper plug, and a third wiper plug. The method further includes: launching a first release plug or tag into the workstring; pumping cement slurry into the workstring, thereby driving the first release plug or tag along the workstring; after pumping the cement slurry, launching a second release plug or tag into the workstring; and pumping chaser fluid into the workstring, thereby driving the release plugs or tags and cement slurry through the workstring. The release plugs or tags engage and release the respective wiper plugs from the workstring. The first wiper plug or release plug ruptures, thereby allowing the cement slurry to flow therethrough and into an annulus formed between the tieback casing string and an outer casing string. The method further includes stabbing the tieback casing string into a liner string; and retrieving the workstring, the workstring still including the third wiper plug.

A method for casing a subsea wellbore includes running a tieback casing string into the subsea wellbore using a workstring. The workstring includes a first wiper plug, a second wiper plug, and a third wiper plug. The method further includes: launching a first release plug or tag into the workstring; pumping cement slurry into the workstring, thereby driving the first release plug or tag along the workstring; after pumping the cement slurry, launching a second release plug or tag into the workstring; and pumping chaser fluid into the workstring, thereby driving the release plugs or tags and cement slurry through the workstring. The release plugs or tags engage and release the respective wiper plugs from the workstring. The first wiper plug or release plug ruptures, thereby allowing the cement slurry to flow therethrough and into an annulus formed between the tieback casing string and an outer casing string. The method further includes: pumping conditioner fluid into the workstring, thereby rupturing the second wiper plug or release plug and flushing the cement slurry from the annulus; pumping remedial cement slurry into the workstring; after pumping the remedial cement slurry, launching a third release plug or tag into the workstring; pumping the chaser fluid into workstring, thereby driving the third release plug or tag and remedial cement slurry through the workstring. The third engages and releases the third wiper plug. The third wiper plug drives the remedial cement slurry into the annulus. The method further includes stabbing the tieback casing string into a liner string; and retrieving the workstring.

A plug release system includes a first wiper plug including a burst tube, the first burst tube adapted to burst at a pressure between 900 psi and 1100 psi; a second wiper plug including a burst tube, the second burst tube adapted to burst at a pressure between 3500 psi and 5000 psi; and a third wiper plug; wherein: the first wiper plug is coupled to the second wiper plug by a shearable fastener, the shearable fastener adapted to shear at a pressure between 500 psi and 700 psi; and the second wiper plug is coupled to the third wiper plug by a shearable fastener, the shearable fastener adapted to shear at a pressure between 1300 psi and 1700 psi.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1A:
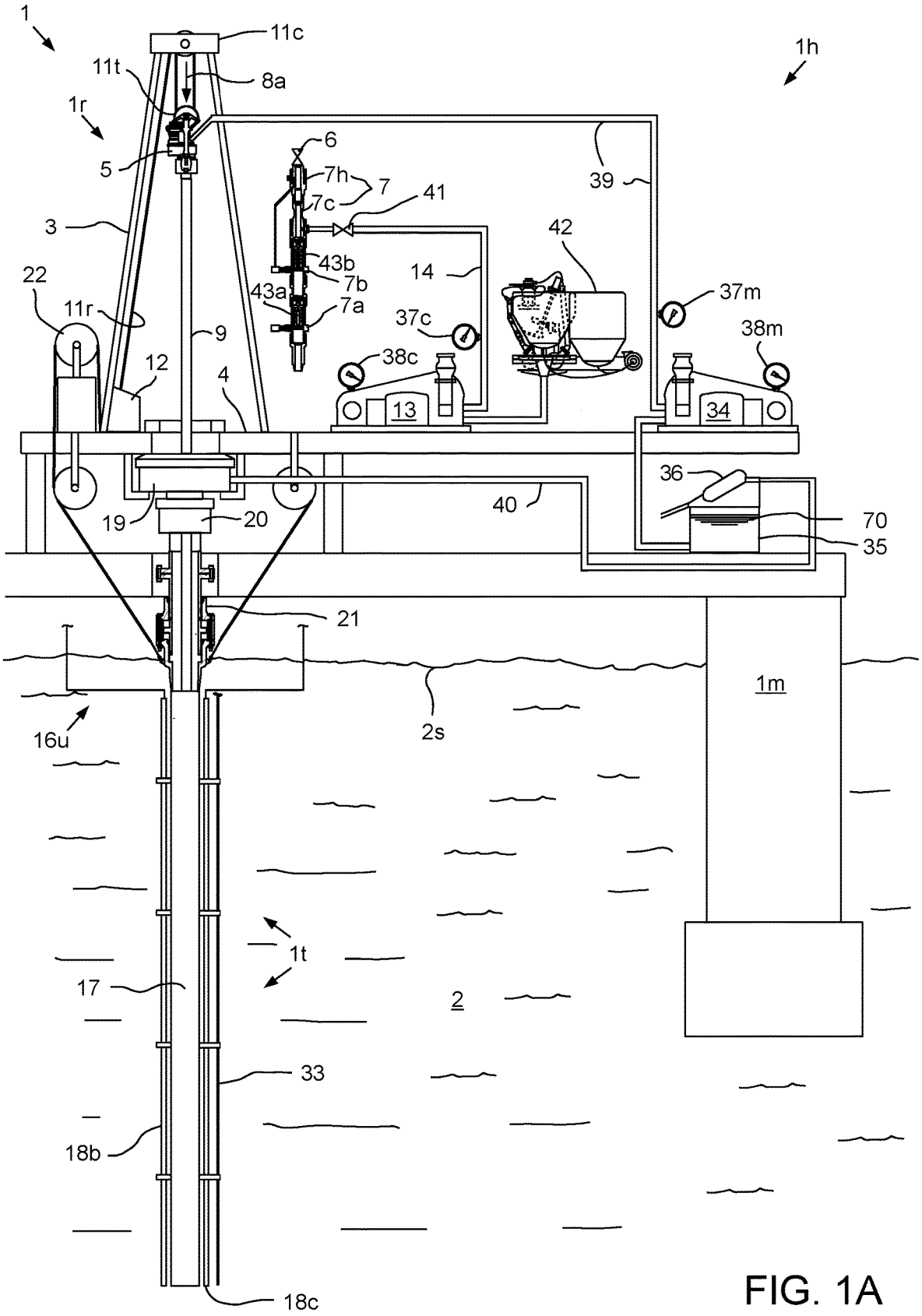
FIGS. 1A-1C illustrate a drilling system in a tieback casing deployment mode, according to one embodiment of this disclosure.
Figure 1B:
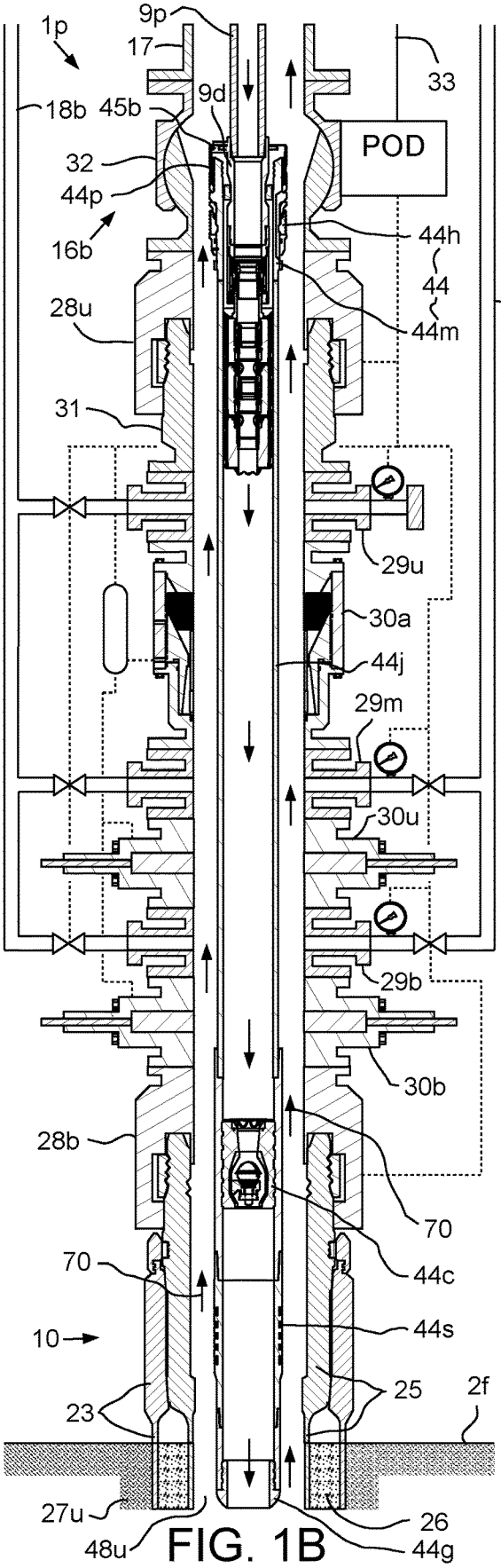
Figure 1C:
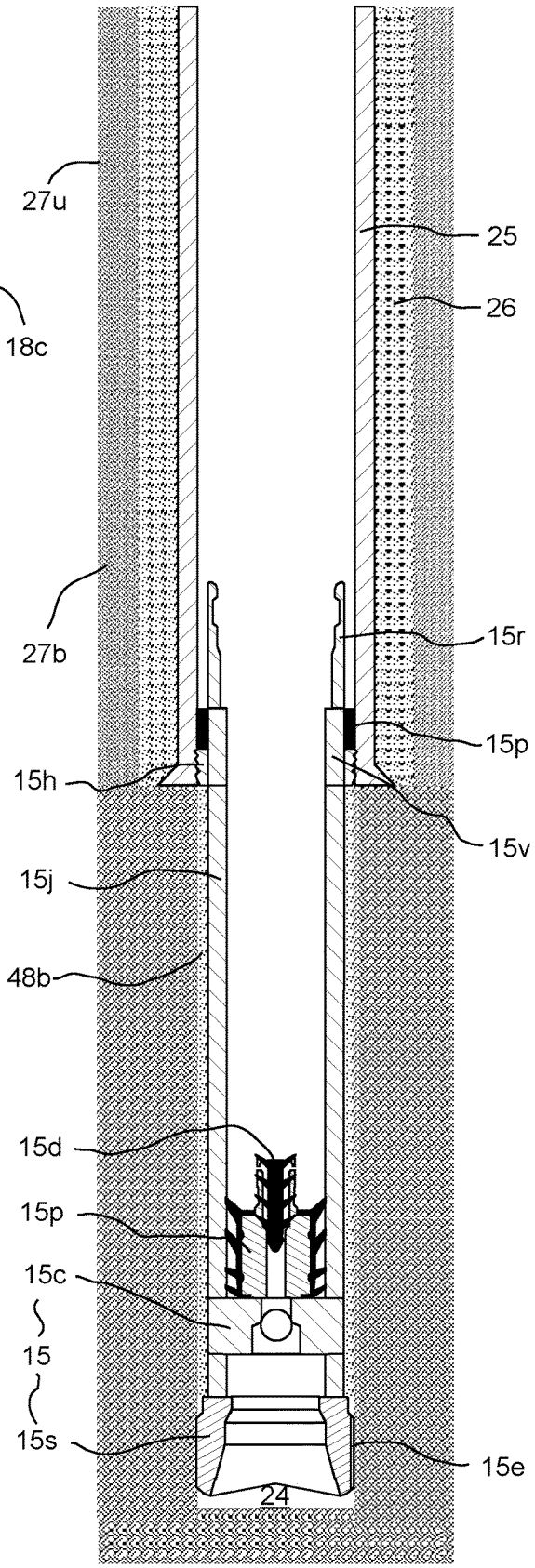

FIGS. 1A-1C illustrate a drilling system 1 in a tieback casing deployment mode, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system 1*t*, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4, a top drive 5, a cementing head 7, and a hoist. The top drive 5 may include a motor for rotating the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block 11*t* of the hoist. The frame of the top drive 5 may be suspended from the derrick 3 by the traveling block 11*t*. The quill may be torsionally driven by the top drive motor and supported from the frame by bearings. The top drive 5 may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3. The drilling rig 1*r* may further include a drill string compensator (not shown) to account for heave of the MODU 1*m*. The drill string compensator may be disposed between the traveling block 11*t* and the top drive 5 (aka hook mounted) or between the crown block 11*c* and the derrick 3 (aka top mounted).

Alternatively, a Kelly and rotary table may be used instead of the top drive.

In the deployment mode, an upper end of the workstring 9 may be connected to the top drive quill, such as by threaded couplings. The workstring 9 may include a tieback deployment assembly (TDA) 9*d* and a deployment string, such as joints of drill pipe 9*p* connected together, such as by threaded couplings. An upper end of the TDA 9*d* may be connected a lower end of the drill pipe 9*p*, such as by threaded couplings. The TDA 9*d* may be connected to the tieback casing string 44, such as by engagement of a bayonet lug 45*b* with a mating bayonet profile formed in an upper end of the tieback casing string. The tieback casing string 44 may include a packer 44*p*, a casing hanger 44*h*, a mandrel 44*m* for carrying the hanger and packer and having a seal bore formed therein, joints of casing 44*j*, a float collar 44*c*, a seal stem 44*s*, and a guide shoe 44*g*. The tieback casing components may be interconnected, such as by threaded couplings.

Once deployment of the tieback casing string has concluded, the workstring 9 may be disconnected from the top drive 5 and the cementing head 7 may be inserted and connected between the top drive 5 and the workstring 9. The cementing head 7 may include an isolation valve 6, an actuator swivel 7*h*, a cementing swivel 7*c*, and one or more plug launchers, such as a first dart launcher 7*a* and a second dart launcher 7*b*. The isolation valve 6 may be connected to a quill of the top drive 5 and an upper end of the actuator swivel 7*h*, such as by threaded couplings. An upper end of the workstring 9 may be connected to a lower end of the cementing head 7, such as by threaded couplings.

The cementing swivel 7*c* may include a housing torsionally connected to the derrick 3, such as by bars, wire rope, or a bracket (not shown). The torsional connection may accommodate longitudinal movement of the swivel 7*c* relative to the derrick 3. The cementing swivel 7*c* may further include a mandrel and bearings for supporting the housing from the mandrel while accommodating rotation of the mandrel. An upper end of the mandrel may be connected to a lower end of the actuator swivel, such as by threaded couplings. The cementing swivel 7*c* may further include an inlet formed through a wall of the housing and in fluid communication with a port formed through the mandrel and a seal assembly for isolating the inlet-port communication. The cementing mandrel port may provide fluid communication between a bore of the cementing head and the housing inlet. The actuator swivel 7*h* may be similar to the cementing swivel 7*c* except that the housing may have three inlets in fluid communication with respective passages formed through the mandrel. The mandrel passages may extend to respective outlets of the mandrel for connection to respective hydraulic conduits (only one shown) for operating respective hydraulic actuators of the plug launchers 7*a,b*. The actuator swivel inlets may be in fluid communication with a hydraulic power unit (HPU, not shown).

Each dart launcher 7*a,b* may include a body, a diverter, a canister, a latch, and the actuator. Each body may be tubular and may have a bore therethrough. To facilitate assembly, each body may include two or more sections connected together, such as by threaded couplings. An upper end of the top dart launcher body may be connected to a lower end of the actuator swivel 7*h*, such as by threaded couplings and a lower end of the bottom dart launcher body may be connected to the workstring 9. Each body may further have a landing shoulder formed in an inner surface thereof. Each canister and diverter may each be disposed in the respective body bore. Each diverter may be connected to the respective body, such as by threaded couplings. Each canister may be longitudinally movable relative to the respective body. Each canister may be tubular and have ribs formed along and around an outer surface thereof. Bypass passages may be formed between the ribs. Each canister may further have a landing shoulder formed in a lower end thereof corresponding to the respective body landing shoulder. Each diverter may be operable to deflect fluid received from a cement line 14 away from a bore of the respective canister and toward the bypass passages. A release dart, such as a first dart 43*a* or a second dart 43*b*, may be disposed in the respective canister bore.

Each latch may include a body, a plunger, and a shaft. Each latch body may be connected to a respective lug formed in an outer surface of the respective launcher body, such as by threaded couplings. Each plunger may be longitudinally movable relative to the respective latch body and radially movable relative to the respective launcher body between a capture position and a release position. Each plunger may be moved between the positions by interaction, such as a jackscrew, with the respective shaft. Each shaft may be longitudinally connected to and rotatable relative to the respective latch body. Each actuator may be a hydraulic motor operable to rotate the shaft relative to the latch body.

Alternatively, the actuator swivel and launcher actuators may be pneumatic or electric. Alternatively, the dart launcher actuators may be linear, such as piston and cylinders.

In operation, when it is desired to launch one of the darts 43*a,b*, the HPU may be operated to supply hydraulic fluid to the appropriate launcher actuator via the actuator swivel 7*h*. The selected launcher actuator may then move the plunger to the release position (not shown). If one of the dart launchers 7*a,b* is selected, the respective canister and dart 43*a,b* may then move downward relative to the body until the landing shoulders engage. Engagement of the landing shoulders may close the respective canister bypass passages, thereby forcing fluid to flow into the canister bore. The fluid may then propel the respective dart 43*a,b* from the canister bore into a lower bore of the body and onward through the workstring 9.

The fluid transport system 1*t* may include an upper marine riser package (UMRP) 16*u*, a marine riser 17, a booster line 18*b*, and a choke line 18*c*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 21, such as by a flanged connection. The diverter 21 may also be connected to the rig floor 4, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and a casing string 25 may be deployed into the wellbore. The casing string 25 may include a wellhead housing and joints of casing connected together, such as by threaded couplings. The wellhead housing may land in the conductor housing during deployment of the casing string 25. The casing string 25 may be cemented 26 into the wellbore 24. The casing string 25 may extend to a depth adjacent a bottom of the upper formation 27*u*. The wellbore 24 may then be extended into the lower formation 27*b* using a pilot bit and underreamer (not shown).

The lower formation 27*b* may be lined by deployment, hanging, cementing of lower annulus 48*b*, and sealing of a liner string 15. The liner string 15 may include, a packer 15*p*, a liner hanger 15*h*, a body 15*v* for carrying the hanger and packer (HP body), joints of liner 15*j*, a landing collar 15*c*, and a reamer shoe 15*s*. The HP body 15*v*, liner joints 15*j*, landing collar 15*c*, and reamer shoe 15*s* may be interconnected, such as by threaded couplings.

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a rig controller (not shown) onboard the MODU 1*m* via an umbilical 33. The control pod may include one or more control valves (not shown) in communication with the BOPs 30*a,u,b* for operation thereof. Each control valve may include an electric or hydraulic actuator in communication with the umbilical 33. The umbilical 33 may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The rig controller may operate the PCA 1*p* via the umbilical 33 and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. Alternatively, a separate kill line (not shown) may be connected to the branches of the flow crosses 29*m,b* instead of the booster manifold. An upper end of the booster line 18*b* may be connected to an outlet of a booster pump (not shown). A lower end of the choke line 18*c* may have prongs connected to respective second branches of the flow crosses 29*m,b*. Shutoff valves may be disposed in respective prongs of the choke line lower end.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33 may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical may be extended between the MODU and the PCA independently of the riser. Alternatively, the shutoff valve actuators may be electrical or pneumatic.

The fluid handling system 1*h* may include one or more pumps, such as a cement pump 13 and a mud pump 34, a reservoir, such as a tank 35, a solids separator, such as a shale shaker 36, one or more pressure gauges 37*c,m*, one or more stroke counters 38*c,m*, one or more flow lines, such as cement line 14, mud line 39, and return line 40, and a cement mixer 42. In the drilling mode, the tank 35 may be filled with drilling fluid, such as mud (not shown). In the tieback deployment mode, the tank 35 may be filled with conditioner 70.

A first end of the return line 40 may be connected to the diverter outlet and a second end of the return line may be connected to an inlet of the shaker 36. A lower end of the mud line 39 may be connected to an outlet of the mud pump 34 and an upper end of the mud line may be connected to the top drive inlet. The pressure gauge 37*m* may be assembled as part of the mud line 39. An upper end of the cement line 14 may be connected to the cementing swivel inlet and a lower end of the cement line may be connected to an outlet of the cement pump 13. The shutoff valve 41 and the pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

During deployment of the tieback casing string 44, the workstring 9 may be lowered 8*a* by the traveling block 11*t* and the conditioner 70 may be pumped into the workstring bore by the mud pump 34 via the mud line 39 and top drive 5. The conditioner 70 may flow down the workstring bore and the liner string bore and be discharged by the guide shoe 44*g* into an upper annulus 48*u* formed between the tieback string 44 and the casing string 25. The conditioner 70 may flow up the upper annulus 48*u* and exit the wellbore 24 and flow into an annulus formed between the riser 17 and the workstring 9/tieback string 44 via an annulus of the LMRP 16*b*, BOP stack, and wellhead 10. The conditioner 70 may exit the riser annulus and enter the return line 40 via an annulus of the UMRP 16*u* and the diverter 19. The conditioner 70 may flow through the return line 40 and into the shale shaker inlet. The conditioner 70 may be processed by the shale shaker 36 to remove any particulates therefrom.

Figure 2:
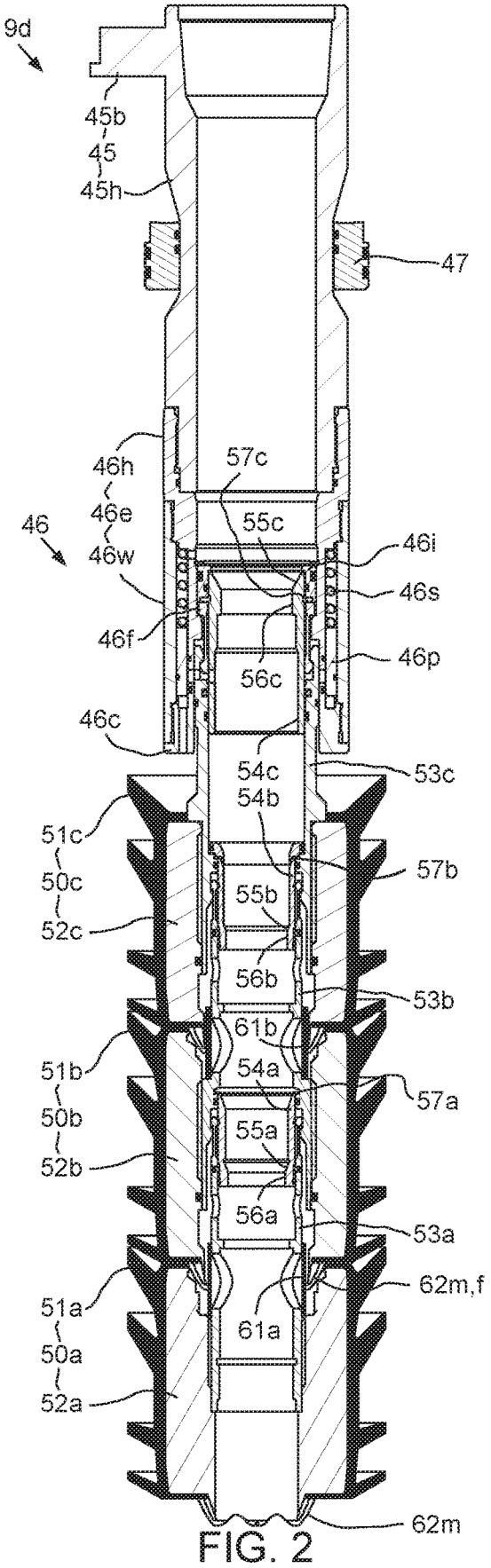
FIG. 2 illustrates a tieback deployment assembly, according to one embodiment of this disclosure.
Figure 3A:
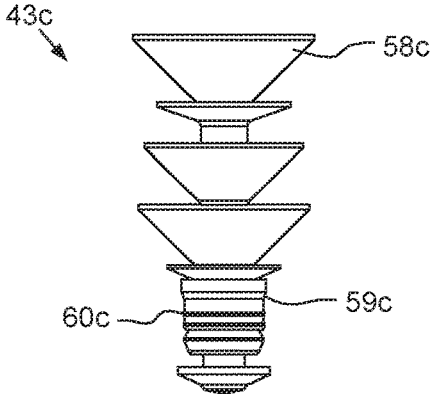
FIGS. 3A-3C illustrate darts for releasing wiper plugs of the tieback deployment assembly.
Figure 3B:
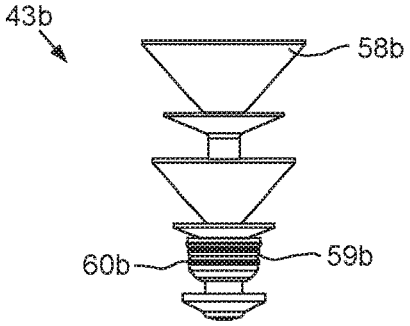
Figure 3C:
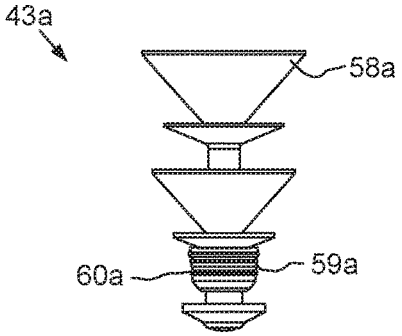

FIG. 2 illustrates the TDA 9*d*. FIGS. 3A-3C illustrate darts 43*a-c* for releasing respective wiper plugs 50*a-c* of the TDA 9*d*. The TDA 9*d* may include a running tool 45, a plug release system 46, and a packoff 47. The packoff 47 may be disposed in a recess of a housing 45*h* of the running tool 45 and carry inner and outer seals for isolating an interface between the tieback casing string 44 and the TDA 9*d* by engagement with the seal bore of the mandrel 44*m*. The running tool housing 45*h* may be connected to a housing 46*h* of the plug release system 46, such as by threaded couplings.

The plug release system 46 may include an equalization valve 46*e*, a first wiper plug 50*a*, a second wiper plug 50*b*, and third wiper plug 50*c*. The equalization valve 46*e* may include a housing 46*h*, an outer wall 46*w*, a cap 46*c*, a piston 46*p*, a spring 46*s*, a collet 46*f*, and a seal insert 46*i*. The housing 46*h*, outer wall 46*w*, and cap 46*c* may be interconnected, such as by threaded couplings. The piston 46*p* and spring 46*s* may be disposed in an annular chamber formed radially between the housing and the outer wall and longitudinally between a shoulder of the housing 46*h* and a shoulder of the cap 46*c*. The piston 46*p* may divide the chamber into an upper portion and a lower portion and carry a seal for isolating the portions. The cap 46*c* and housing 46*h* may also carry seals for isolating the portions. The spring 46*s* may bias the piston 46*p* toward the cap 46*c*. The cap 46*c* may have a port formed therethrough for providing fluid communication between the upper annulus 48*u* and the chamber lower portion and the housing 46*h* may have a port formed through a wall thereof for venting the upper chamber portion. An outlet port may be formed by a gap between a bottom of the housing 46*h* and a top of the cap 46*c*. As pressure from the upper annulus 48*u* acts against a lower surface of the piston 46*p* through the cap passage, the piston 46*p* may move upward and open the outlet port to facilitate equalization of pressure between the annulus and a bore of the housing 46*h* to prevent surge pressure from prematurely releasing one or more of the plugs 50*a-c*.

Each wiper plug 50*a-c* may be made from a drillable material and include a respective finned seal 51*a-c*, a plug body 52*a-c*, a latch sleeve 53*a-c*, and a lock sleeve 54*a-c*. Each latch sleeve 53*a-c* may have a collet formed in an upper end thereof and the second and third latch sleeves 53*b,c* may each have a respective collet profile formed in a lower portion thereof. Each lock sleeve 54*a-c* may have a respective seat 55*a-c* and seal bore 56*a-c* formed therein. Each lock sleeve 54*a-c* may be movable between an upper position and a lower position and be releasably restrained in the upper position by a respective shearable fastener 57*a-c*. Each dart 43*a-c* may be made from a drillable material and include a respective finned seal 58*a-c* and dart body. Each dart body may have a respective landing shoulder 59*a-c* and carry a respective landing seal 60*a-c* for engagement with the respective seat 55*a-c* and seal bore 56*a-c*. A major diameter of the first landing shoulder 59*a* may be less than a minor diameter of the second seat 55*b* and a major diameter of the second landing shoulder 59*b* may be less than a minor diameter of the third seat 55*c* such that the first dart 43*a* may pass through the second 50*b* and third 50*c* wiper plugs and the second dart 43*b* may pass through the third wiper plug.

The third shearable fastener 57*c* may releasably connect the third lock sleeve 54*c* to the valve housing 46*h* and the third lock sleeve 54*c* may be engaged with the valve collet 46*f* in the upper position, thereby locking the valve collet into engagement with the collet of the third latch sleeve 53*c*. The second shearable fastener 57*b* may releasably connect the second lock sleeve 54*b* to the third lock sleeve 53*c* and the second lock sleeve 54*b* may be engaged with the collet of the second latch sleeve 53*b*, thereby locking the collet into engagement with the collet profile of the third latch sleeve. The first shearable fastener 57*a* may releasably connect the first lock sleeve 54*a* to the second latch sleeve 53*b* and the second lock sleeve 54*b* may be engaged with the collet of the first latch sleeve 53*a*, thereby locking the collet into engagement with the collet profile of the second latch sleeve 53*b*. A release pressure necessary to fracture the first shearable fastener 57*a* may be substantially less than the release pressure necessary to fracture the second shearable fastener 57*b* which may be substantially less than the release pressure necessary to fracture the third shearable fastener 57*c*.

The first 50*a* and second 50*b* wiper plugs may each include one or more (pair shown) bypass ports formed through a wall of the respective latch sleeves 53*a,b* initially sealed by respective burst tubes 61*a,b* to prevent fluid flow therethrough. The burst tubes 61*a,b* are adapted to rupture when a predetermined pressure is applied thereto and a rupture pressure of the first burst tube 61*a* may be substantially less than a rupture pressure of the second burst tube 61*b*. The rupture pressure of the first burst tube 61*a* may also be substantially greater than the release pressure of the first wiper plug 50*a* and substantially less than the release pressure of the second wiper plug 50*b*. The rupture pressure of the second burst tube 61*b* may also be substantially greater than the release pressure of the second wiper plug 50*b* and substantially greater than the release pressure of the third wiper plug 50*b*.

The first wiper plug 50*a* may be released at a pressure ranging between 500 psi to 700 psi, the second wiper plug 50*b* may be released at a pressure ranging between 1300 psi to 1700 psi, and the third wiper plug 50*c* at a pressure ranging between 2000 psi to 2400 psi. The first burst tube 61*a* may rupture at a pressure ranging between 900 psi to 1100 psi and the second burst tube 61*b* may rupture at a pressure ranging between 3500 psi to 5000 psi.

Alternatively, the first dart 43*a* and the second dart 43*b* may include rupture disks or burst tubes rather than or in addition to the burst tubes 61*a,b* of the wiper plugs 50*a,b*. Thus, rupturing the of the burst tube within the first dart 43*a* or the second dart 43*b* would allow fluid flow therethrough when seated within a respective wiper plug.

To facilitate subsequent drill-out, each plug body 50*a-c* may further have a portion of an auto-orienting torsional profile 62*m,f* formed at a longitudinal end thereof. The first and second plug bodies 50*a,b* may each have the female portion 62*f* and male portion 62*m* formed at respective upper and lower ends thereof (or vice versa). The third plug body 50*c* may have only the male portion formed at the lower end thereof.

Figure 4:
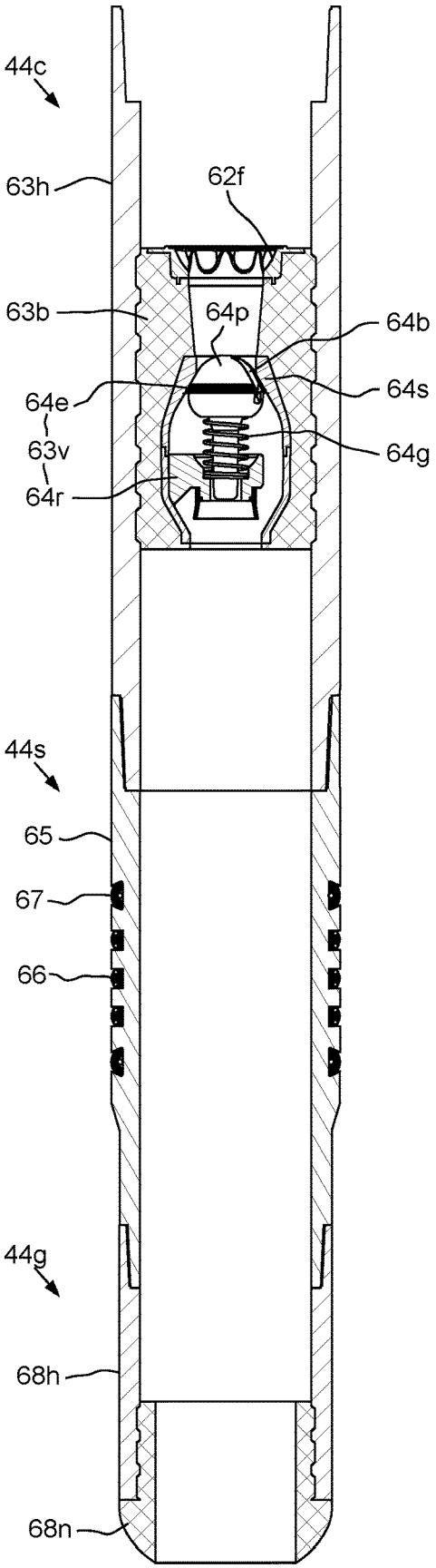
FIG. 4 illustrates a lower portion of the tieback casing string.

FIG. 4 illustrates a lower portion of the tieback casing string 44. The float collar 44*c* may include a housing 63*h*, a check valve 63*v*, and a body 63*b*. The body 63*b* and check valve 63*v* may be made from drillable materials. The body 63*b* may have a bore formed therethrough and the torsional profile female portion 62*f* formed in an upper end thereof for receiving the first wiper plug 50*a*. The check valve 63*v* may include a seat 64*s*, a poppet 64*p* disposed within the seat, a seal 64*e* disposed around the poppet and adapted to contact an inner surface of the seat to close the body bore, and a rib 64*r*. The poppet 64*p* may have a head portion and a stem portion. The rib 64*r* may support a stem portion of the poppet 64*p*. A spring 64*g* may be disposed around the stem portion and may bias the poppet 64*p* against the seat 64*s* to facilitate sealing. The poppet 64*p* may have a bypass slot 64*b* formed therein to prohibit the occurrence of hydraulic lock when stabbing the seal stem 44*s* into the PBR 15*r* by allowing fluid to pass around the closed poppet.

During deployment of the tieback casing string 44, the conditioner 70 may be pumped to prepare the upper annulus 48*u* for cementing. The conditioner 70 may be pumped down at a sufficient pressure to overcome the bias of the spring 64*g*, actuating the poppet 62*s* downward to allow conditioner 70 to flow through the bore of the body 63*b*.

The seal stem 44*s* may include a gland 65, one or more (three shown) seals 66, and a pair of wipers 67 straddling the seals. During stabbing of the seal stem 44*s*, the seals 66 may engage an inner surface of the PBR 15*r* while the wipers 67 displace particulates therefrom to ensure proper sealing. The wipers 67 and seals 66 may be positioned in grooves formed within an outer surface of the gland 65 to fix the wipers and the seals in place. During stabbing, the seals 66 initially engage the PBR 15*r* and change configuration to occupy an interface between the gland 65 and the PBR. The seals 66 may each include a protrusion for contact with the PBR 15*r* and energization thereof in response to the contact. The gland 65 may have a guide shoulder that is adapted to facilitate guidance of the tieback casing 44 in to the PBR 15*r*.

The guide shoe 44*g* may include a housing 68*h* and a nose 68*n* made from a drillable material. The nose 68*n* may have a rounded distal end to guide the tieback casing 44 down the casing 25 and into the PBR 15*r*.

Figures 5A, 5B, 5C, 5D:
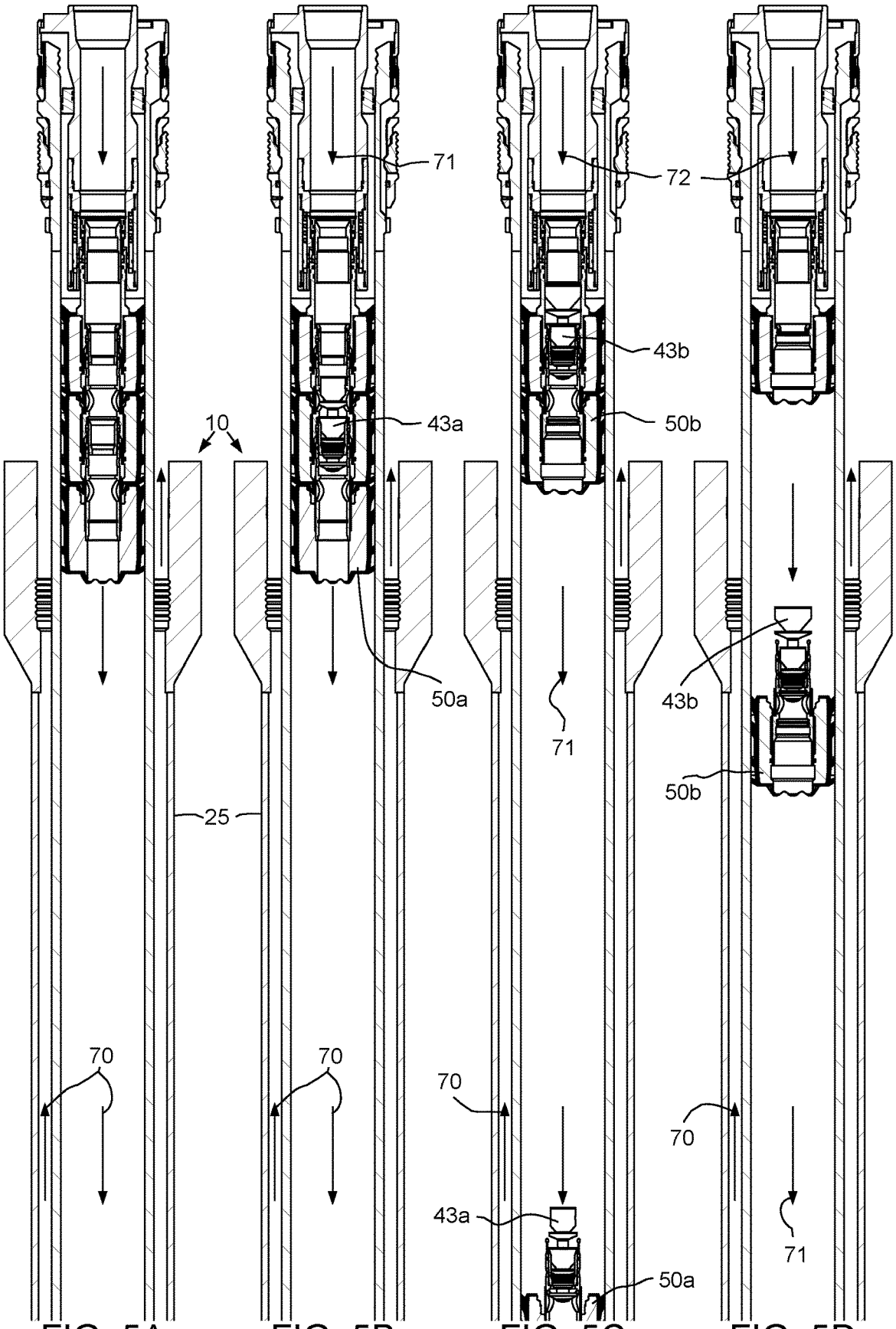

FIGS. 5A-5G, 6A-6G and 7 illustrate a primary tieback cementing operation using the TDA 9*d*. As illustrated in FIGS. 5A and 6A, the tie back casing string 44 is lowered 8*a* until the packer 44*p*, hanger 44*h*, and mandrel 44*m* thereof are positioned proximately above the subsea wellhead 10 and the guide shoe 44*g* is positioned proximately above the PBR 15*r* to form a gap 69 therebetween. The gap 69 provides a fluid path from the bore of the tieback casing string 44 to the upper annulus 48*u* for the tieback cementing operation.

As illustrated in FIGS. 5B and 6B, the first dart 43*a* may be released from the first launcher 7*a* by operating the first plug launcher actuator. Cement slurry 71 may be pumped from the mixer 42 into the cementing swivel 7*c* via the valve 41 by the cement pump 13. The cement slurry 71 may flow into the second launcher 7*b* and be diverted past the second dart 43*b* via the diverter and bypass passages. The cement slurry 71 may flow into the first launcher 7*a* and be forced behind the first dart 43*a* by closing of the bypass passages, thereby propelling the first dart into the workstring bore.

Once the desired quantity of cement slurry 71 has been pumped, the second dart 43*b* may be released from the second launcher 7*b* by operating the second plug launcher actuator. Chaser fluid 72 may be pumped into the cementing swivel 7*c* via the valve 41 by the cement pump 13. The chaser fluid 72 may flow into the second launcher 7*b* and be forced behind the second dart 43*b* by closing of the bypass passages, thereby propelling the second dart into the workstring bore. Pumping of the chaser fluid 72 by the cement pump 13 may continue until residual cement in the cement line 14 has been purged. Pumping of the chaser fluid 72 may then be transferred to the mud pump 34 by closing the valve 41 and opening the valve 6. The train of darts 43*a,b* and cement slurry 71 may be driven through the workstring bore by the chaser fluid 72. The first dart 43*a* may reach the first wiper plug 50*a* and the landing shoulder 59*a* and seal 60*a* of the first dart may engage the seat 55*a* and seal bore 56*a* of the first wiper plug.

As shown in FIGS. 5C and 6C, continued pumping of the chaser fluid 72 may increase pressure in the workstring bore against the seated first dart 43*a* until the first release pressure is achieved, thereby fracturing the first shearable fastener 57*a*. The first dart 43*a* and lock sleeve 54*a* of the first wiper plug 50*a* may travel downward until reaching a stop of the first wiper plug, thereby freeing the collet of the first latch sleeve 53*a* and releasing the first wiper plug from the second wiper plug 50*b*. The released first dart 43*a* and first wiper plug 50*a* may travel down the bore of the tieback casing string 44 wiping the inner surface thereof and forcing the conditioner 70 therethrough. The second dart 43*b* may then reach the second wiper plug 50*b* and the landing shoulder 59*b* and seal 60*b* of the second dart may engage the seat 55*b* and seal bore 56*b* of the second wiper plug.

As shown in FIGS. 5D and 6D, continued pumping of the chaser fluid 72 may increase pressure in the workstring bore against the seated second dart 43*b* until the second release pressure is achieved, thereby fracturing the second shearable fastener 57*b*. The second dart 43*b* and lock sleeve 54*b* of the second wiper plug 50*b* may travel downward until reaching a stop of the second wiper plug, thereby freeing the collet of the second latch sleeve 53*b* and releasing the second wiper plug from the third wiper plug 50*c*. Continued pumping of the chaser fluid 72 may drive the train of darts 43*a,b*, wiper plugs 50*a,b*, and cement slurry 71 through the tieback casing bore until the first wiper plug 50*a* bumps the float collar 44*c*.

Figure 5E:
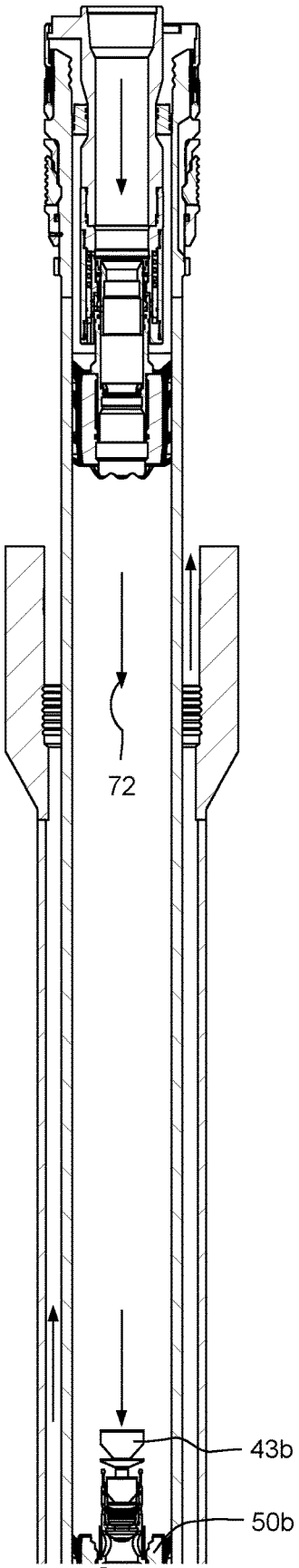
Figures 6A, 6B, 6C, 6D:
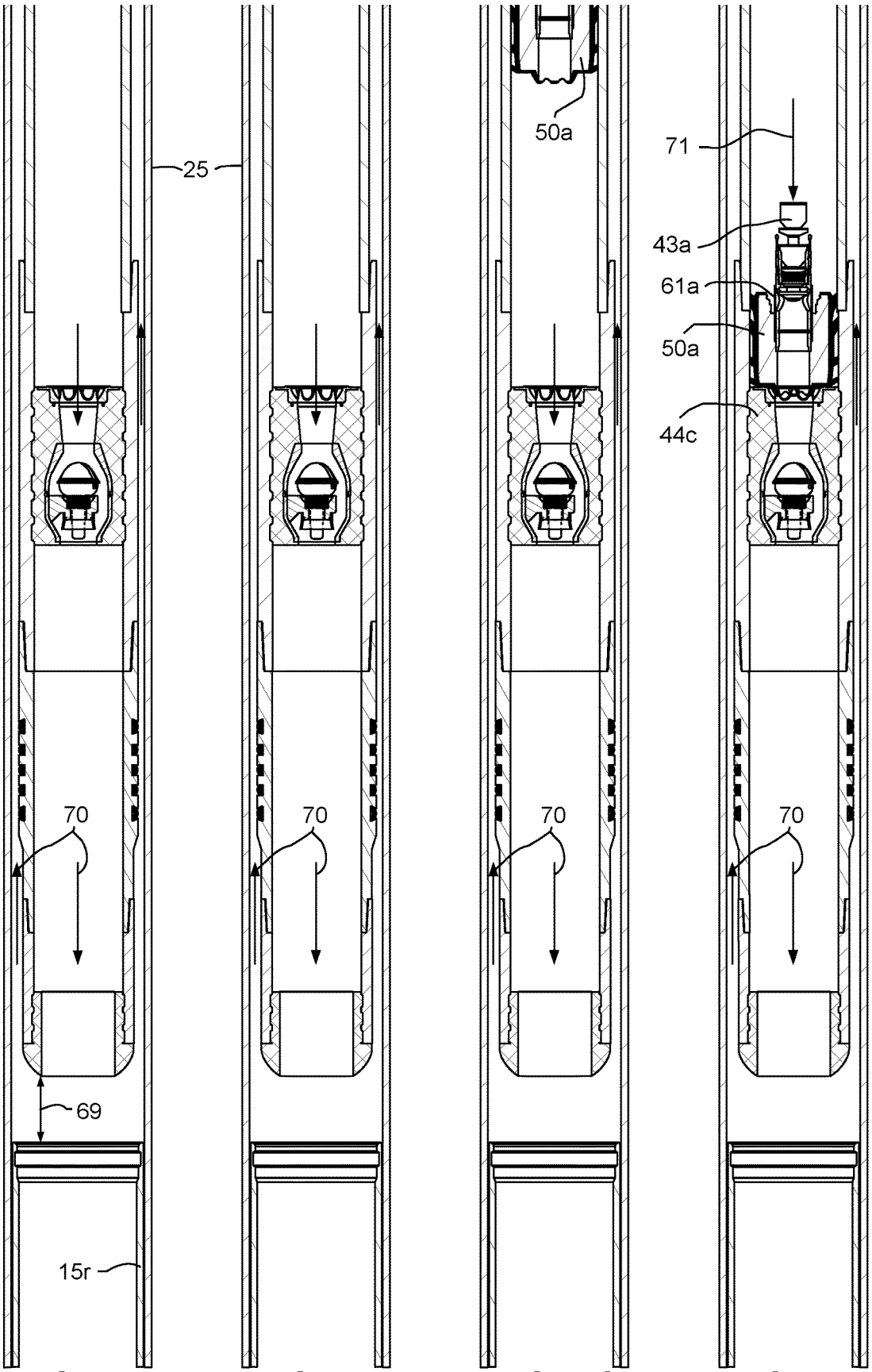
Figure 6E:
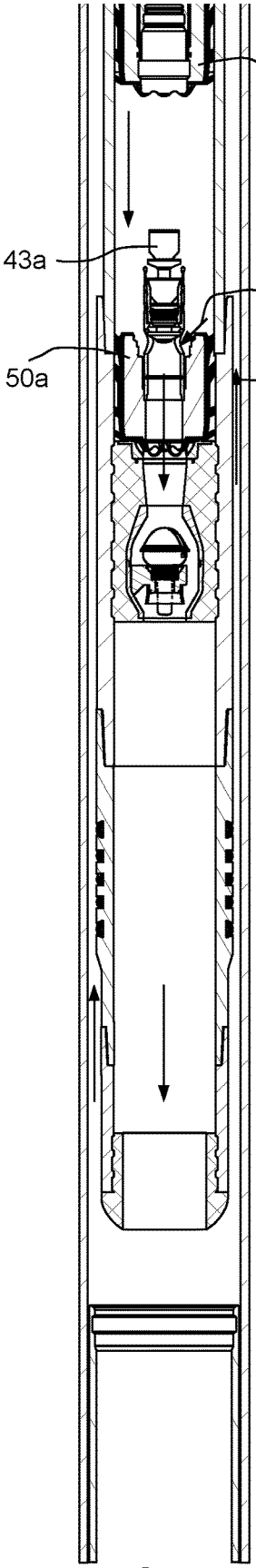

As illustrated in FIGS. 5E and 6E, continued pumping of the chaser fluid 72 may increase pressure in the tieback casing bore against the seated first dart 43*a* and first wiper plug 50*a* until the first rupture pressure is achieved, thereby rupturing the first burst tube 61*a* and opening the bypass ports of the first wiper plug. The cement slurry 71 may flow around the first dart 43*a* and through the first wiper plug, the seal stem 44*s*, and the guide shoe 44*g*, and upward into the upper annulus 48*u* via the gap 69. The cement slurry 71 may be prohibited from flowing down the liner string 15 by the seated liner dart 15*d* and packer 15*p* and a column of incompressible chaser fluid (not shown) in the liner bore.

Figure 5F:
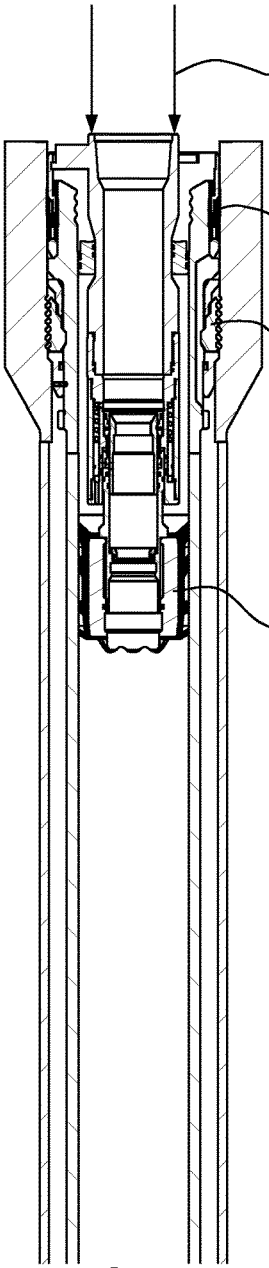
Figure 6F:
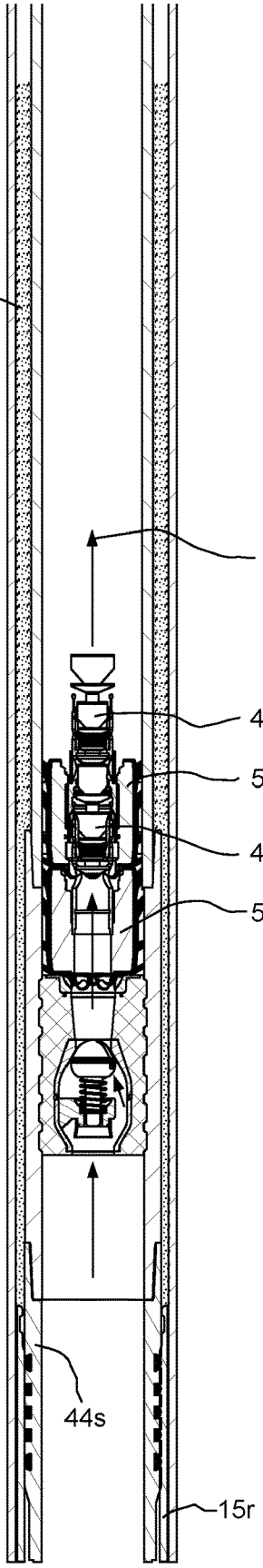

As shown in FIGS. 5F and 6F, pumping of the chaser fluid 72 may continue to drive the cement slurry 71 into the upper annulus 46*u* until the second wiper plug 50*b* bumps the seated first wiper plug 50*a*. Pumping of the chaser fluid 72 may be halted prior to reaching the second rupture pressure, thereby leaving the second burst tube 61*b* intact. The check valve 62*v* may close in response to halting of the pumping. Acceptability of the primary cementing operation may be determined. If acceptable, the workstring 9 may be lowered 74 until a shoulder of the tieback hanger 44*h* engages a seat of the wellhead 10, thereby stabbing the seal stem 44*s* into the PBR 15*r*. Pressure 75 may be relieved upward through the bypass slot of the poppet 64*p* and the first wiper plug 50*a*, and around the directional fins of the second wiper plug 50*b*, thereby avoiding hydraulic lock due to the incompressible cement slurry 71.

Figure 5G:
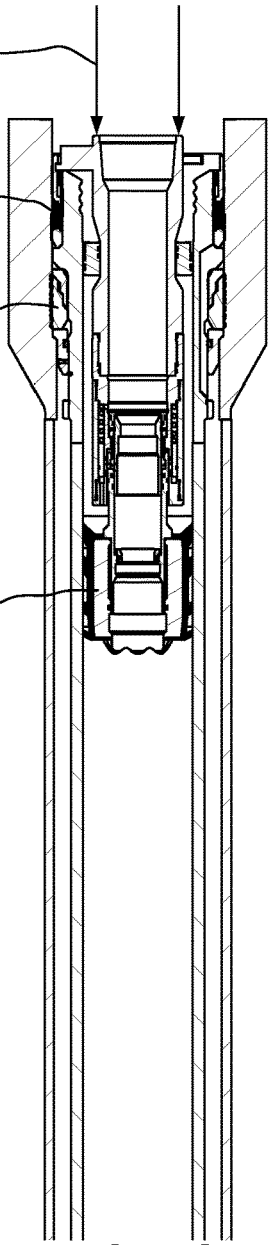
Figure 6G:
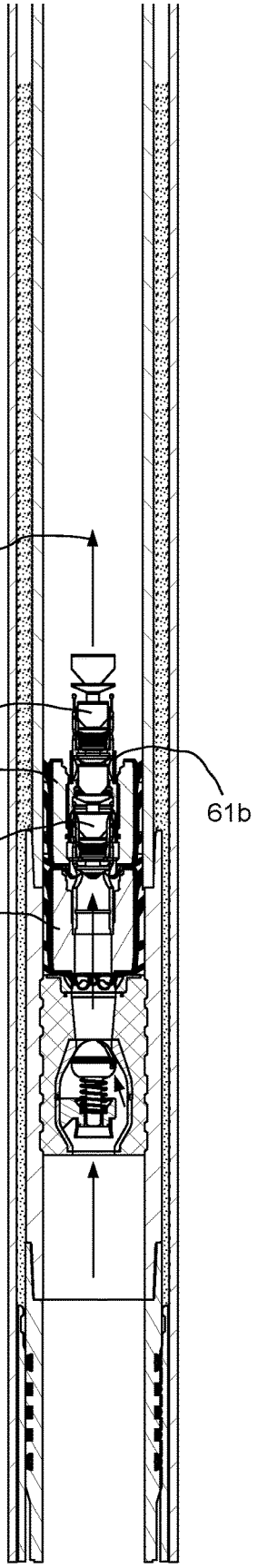

As illustrated in FIGS. 5G and 6G, the workstring 9 may continued to be lowered 74, thereby releasing a shearable connection of the tieback hanger 44*h* and driving a cone thereof into dogs thereof, thereby extending the dogs into engagement with a profile of the wellhead 10 and setting the hanger. Continued lowering 74 of the workstring may drive a wedge of the tieback packer 44*p* into a metallic seal ring thereof, thereby extending the seal ring into engagement with a seal bore of the wellhead 10 and setting the packer.

Figure 7:
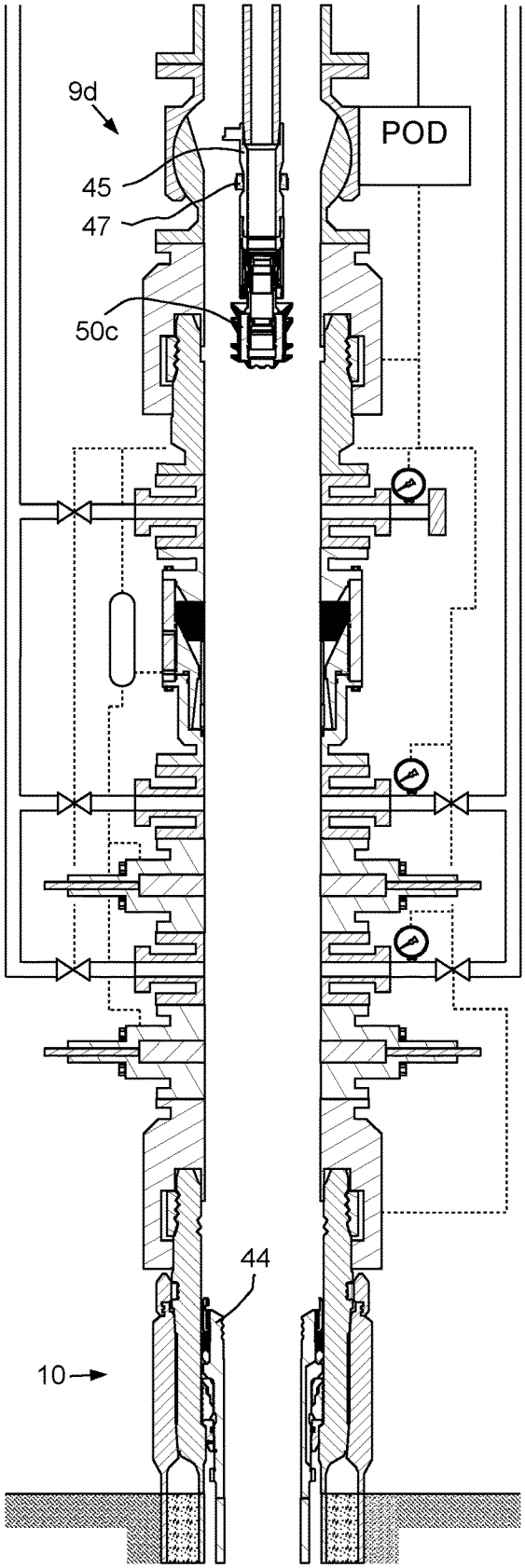
FIGS. 5A-5G, 6A-6G and 7 illustrate a primary tieback cementing operation using the tieback deployment assembly.

As shown in FIG. 7, with the tieback casing string 44 secured in place, the bayonet connection between the TDA 9*d* and the tieback casing 44 may be released and the workstring 9 retrieved to the rig 1*r*. Since the primary cementing operation was deemed successful, the third wiper plug 50*c* remains part of the TDA 9*d* and may be retrieved to the rig 1*r*.

FIGS. 8A-8D and 9A-9D illustrate a remedial tieback cementing operation using the tieback deployment assembly. If the cement slurry 71 does not meet one or more requirements, such as location, composition, or uniformity, the primary cementing operation may be deemed unsuccessful. If not for the presence of the third wiper plug 50*c*, the tieback casing string 44 would need to be removed, the cement slurry 71 would need to be drilled or flushed, and the tieback casing string would then need to be reinserted to allow the cementing operation to be performed again. Such a process would be extremely time consuming and could take on the order of days to complete at considerable expense.

Figures 8A, 8B, 8C, 8D:
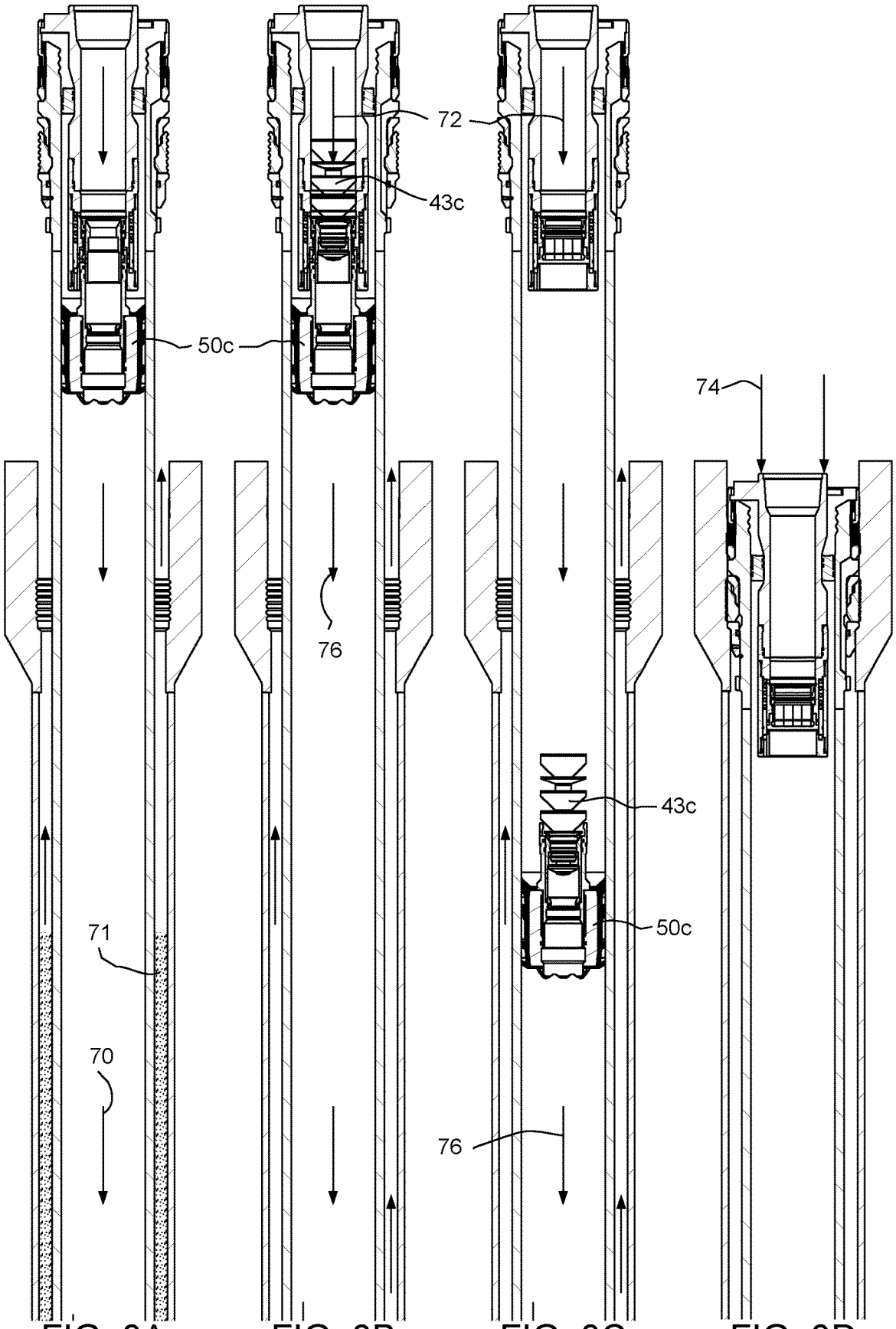
FIGS. 8A-8D and 9A-9D illustrate a remedial tieback cementing operation using the tieback deployment assembly.
Figures 9A, 9B, 9C, 9D:
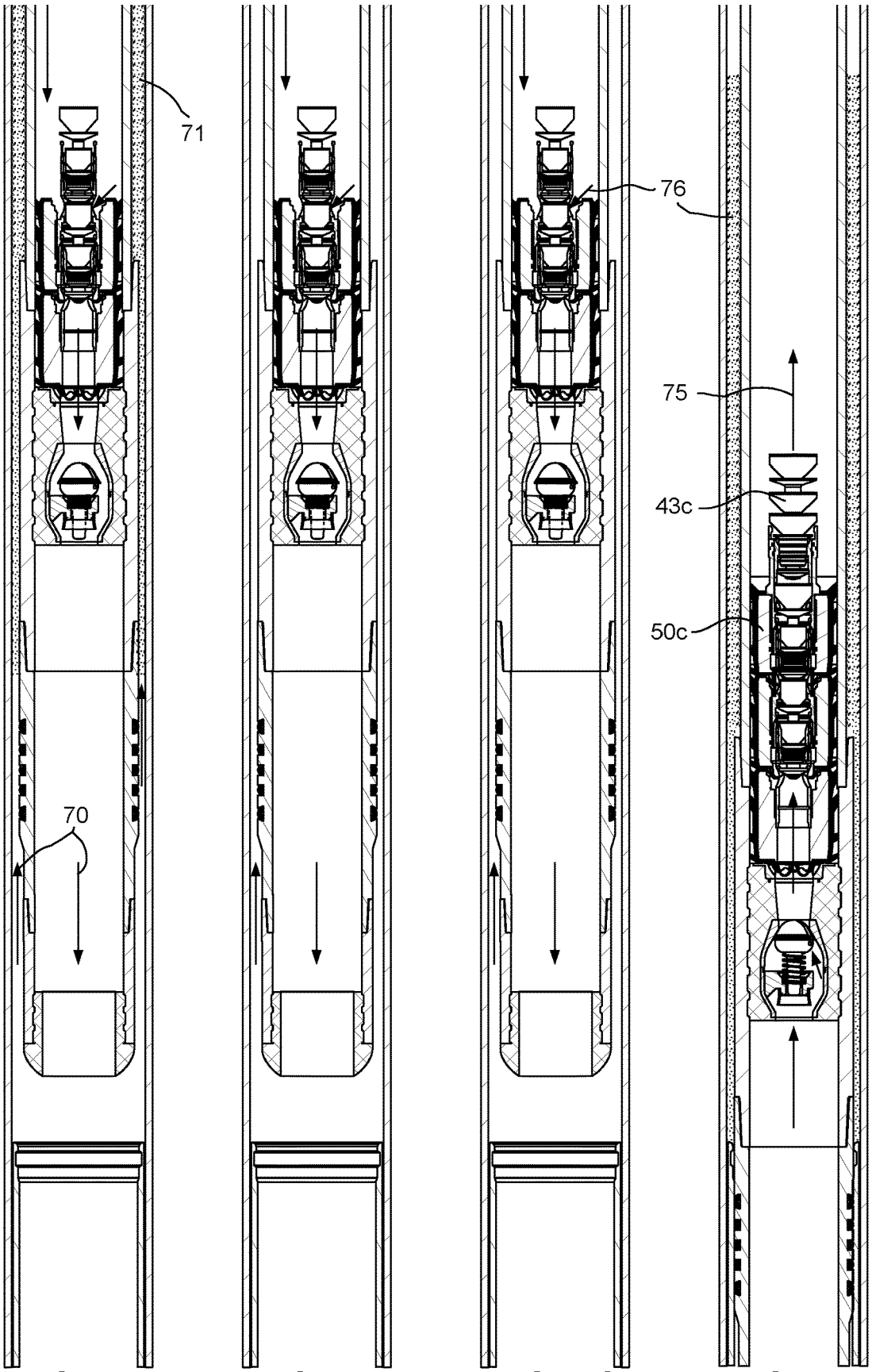

As illustrated in FIGS. 8A and 9A, after recognition of a failed primary cementing operation, the third dart 43*c* may be loaded into one of the launchers 7*a,b* and conditioner 70 may be injected into the workstring 9 to increase pressure in the tieback casing bore against the seated second dart 43*b* and second wiper plug 50*b* until the second rupture pressure is achieved, thereby rupturing the second burst tube 61*b* and opening the bypass ports of the second wiper plug. The conditioner 70 may flow around the second dart 43*a* and through the second wiper plug 50*b*, around the first dart 43*a*, and through the first wiper plug 50*a*, the seal stem 44*s*, and the guide shoe 44*g*, and upward into the upper annulus 48*u* via the gap 69, thereby flushing the failed cement slurry 71 from the upper annulus 48*u*.

As shown in FIGS. 8B and 9B, after flushing the failed cementing slurry 71 from the upper annulus 48*u*, remedial cement slurry 76 may be pumped from the mixer 42 into the cementing swivel 7*c* via the valve 41 by the cement pump 13. Once the desired quantity of remedial cement slurry 76 has been pumped, the third dart 43*c* may be released from the loaded launcher 7*a,b* by operating the respective plug launcher actuator. Chaser fluid 72 may be pumped into the cementing swivel 7*c* via the valve 41 by the cement pump 13. The chaser fluid 72 may flow into the loaded launcher 7*a,b,* thereby propelling the third dart into the workstring bore. Pumping of the chaser fluid 72 by the cement pump 13 may continue until residual cement in the cement line 14 has been purged. Pumping of the chaser fluid 72 may then be transferred to the mud pump 34 by closing the valve 41 and opening the valve 6. The third dart 43*c* and remedial cement slurry 76 may be driven through the workstring bore by the chaser fluid 72. The third dart 43*c* may reach the third wiper plug 50*c* and the landing shoulder 59*c* and seal 60*c* of the third dart may engage the seat 55*c* and seal bore 56*c* of the third wiper plug.

As shown in FIGS. 8C and 9C, continued pumping of the chaser fluid 72 may increase pressure in the workstring bore against the seated third dart 43*c* until the third release pressure is achieved, thereby fracturing the third shearable fastener 57*c*. The third dart 43*c* and lock sleeve 54*c* of the third wiper plug 50*c* may travel downward until reaching a stop of the third wiper plug, thereby freeing the collet 46*f* and releasing the third wiper plug 50*c* from the equalization valve 46*e*. Continued pumping of the chaser fluid 72 may drive the third dart 43*c*, third wiper plug 50*c*, and remedial cement slurry 76 through the tieback casing bore. The remedial cement slurry 76 may flow around the second dart 43*a* and through the second wiper plug 50*b*, around the first dart 43*a*, and through the first wiper plug 50*a*, the seal stem 44*s*, and the guide shoe 44*g*, and upward into the upper annulus 48*u* via the gap 69.

As shown in FIGS. 8D and 9D, pumping of the chaser fluid 72 may continue to drive the remedial cement slurry 76 into the upper annulus 46*u* until the third wiper plug 50*c* bumps the seated second wiper plug 50*b*. Pumping of the chaser fluid 72 may then be halted. The workstring 9 may then be lowered 74, thereby stabbing the seal stem 44*s* into the PBR 15*r* and setting the tieback hanger 44*h* and packer 44*p* against the wellhead 10. The workstring 9 may then be retrieved to the rig 1*r*.

Alternatively, the primary cementing job may be successful but a problem may occur during stabbing of the seal stem 44*s*/landing of the tieback hanger 44*h*. If such problem occurs, the workstring 9 may be raised to reform the gap 69 and then the remedial cementing operation may be performed.

In another embodiment (not shown), the cement head 7 may be omitted and the cement line 14 instead connected to the top drive 5. Further, instead of darts, the release plugs may be balls. Alternatively, RFID tags may be used instead of the balls and gel plugs or foam plugs may be used to separate the fluids. In either instance, launchers may be assembled as part of the cement line 14 and the wiper plugs may each have a flapper valve biased toward a closed position and held in an open position by a single prop sleeve extending through the wiper plugs. The first and second flappers may each have a rupture disk therein to serve the purpose of the burst sleeves, discussed above.

For the tag alternative, a first tag launcher may be operated to release an RFID tag into the cement line 14 and a first foam or gel plug may be launched/injected into the cement line 14. Alternatively, the first foam or gel plug may be omitted. Cement slurry 71 may then be pumped from the mixer 42, through the cement line and top drive, and into the workstring 9 by the cement pump 13. After a desired amount of cement slurry 71 has been pumped, a second RFID tag and a foam/gel plug may be launched/pumped into the cement line 14, through the top drive, and propelled down the workstring 9 by chaser fluid 72. As the first and second RFID tags travel down the workstring, the first RFID tag will travel near an RFID antenna of an electronics package located within mandrel of the plug launch assembly. The first RFID tag sends a signal to the RFID antenna as the tag passes thereby. An MCU may receive the first command signal from the first tag and may operate an actuator controller to energize an actuator to move the prop sleeve upward from engagement with the first wiper plug. Once the upward stroke has finished, the prop sleeve may also be clear of the first wiper plug collet. The flapper of the first wiper plug may then close and pressure may increase thereon until the first plug is released from the second plug. The released first wiper plug may then be propelled through the tieback casing, as described above. The second RFID tag similarly instructs actuation of the prop sleeve to move clear of the second flapper and collet, thereby releasing the second wiper plug. If necessary, a third RFID tag may be used to launch the third wiper plug. A more detailed discussion of plug launching using RFID tags can be found in U.S. patent application Ser. No. 14/083,021, filed Nov. 18, 2013, which is herein incorporated by reference.

For the ball alternative, the prop sleeve may have each ball seat disposed within and releasably connected thereto, such as by a shearable fastener. Each ball seat may close one or flow ports providing fluid communication between the prop sleeve bore and a respective flapper chamber of the respective wiper plug. The first wiper plug may also be releasably connected to the prop sleeve by a shearable fastener. A first ball launcher may be operated to release a first ball into the cement line 14 and cement slurry 71 may then be pumped from the mixer 42, through the cement line and top drive and into the workstring 9 by the cement pump 13. After a desired amount of cement slurry 71 has been pumped, a second ball may be launched into the cement line 14, through the top drive, and propelled down the workstring 9 by chaser fluid 72. The first ball may land in the first seat and release the first seat from the prop sleeve, thereby moving the first sleeve down the prop sleeve until a stop shoulder of the prop sleeve is engaged. The first ports may be opened by the movement of the first seat, thereby allowing the cement slurry to flow into the first flapper chamber and exert pressure on a first piston in the flapper chamber, thereby exerting a downward force on the first wiper plug until the shearable fastener fractures. The downward force may drive the first wiper plug off of the prop sleeve, thereby allowing the first flapper to close. The released first wiper plug may then be propelled through the tieback casing by pressure of the cement slurry acting on the closed flapper. The second ball may release the second wiper plug in a similar fashion and if necessary, a third ball may be launched to release the third wiper plug.

While the foregoing is directed to embodiments of the present disclosure, other and further embodiments of the disclosure may be devised without departing from the basic scope thereof, and the scope of the invention is determined by the claims that follow.

What is claimed is:

1. A work string, comprising:

a float collar including a tubular housing having a check valve disposed within the tubular housing;

a seal stem connected to a lower end of the float collar, wherein the seal stem is configured to stab into a polished bore receptacle disposed in a wellbore;

a guide shoe connected to a lower end of the seal stem;

a plurality of seals disposed around the seal stem and configured to engage the polished bore receptacle; and a plug release system coupled to a running tool and disposed above the float collar, wherein the plug release system includes one or more plugs.

2. The work string of claim 1, wherein the guide shoe includes a rounded distal end.

3. The work string of claim 1, wherein the check valve includes a seat, a poppet disposed within the seat, and a seal disposed around the poppet.

4. The work string of claim 3, wherein the seal contacts an inner surface of the seat to close a bore formed through a body of the check valve.

5. The work string of claim 4, wherein the body includes a torsional profile female portion at an upper end thereof for receiving a plug of the plug release system.

6. The work string of claim 1, wherein the seal stem further comprises wipers straddling the plurality of seals.

7. The work string of claim 6, wherein the wipers are disposed within grooves formed on an outer surface of the seal stem.

8. A work string, comprising:

a tieback deployment assembly including to a plug release system, wherein the plug release system includes one or more plugs; and a tieback casing string coupled to the tieback deployment assembly, the tieback casing string comprising:

a float collar including a tubular housing and having a check valve disposed within the tubular housing;

a seal stem connected to a lower end of the float collar, wherein the seal stem is configured to stab into a polished bore receptacle disposed in a wellbore;

a guide shoe connected to a lower end of the seal stem; and a plurality of seals disposed around the seal stem and configured to engage the polished bore receptacle.

9. The work string of claim 8, wherein the guide shoe includes a rounded distal end.

10. The work string of claim 8, wherein the check valve includes a seat, a poppet disposed within the seat, and a seal disposed around the poppet.

11. The work string of claim 10, wherein the seal contacts an inner surface of the seat to close a bore formed through a body of the check valve.

12. The work string of claim 11, wherein the body includes a torsional profile female portion at an upper end thereof for receiving a plug of the plug release system.

13. The work string of claim 8, wherein the seal stem further comprises wipers straddling the plurality of seals.

14. The work string of claim 13, wherein the wipers are disposed within grooves formed on an outer surface of the seal stem.

15. The work string of claim 8, wherein the one or more plugs are a first wiper plug including a first burst tube, a second wiper plug including a second burst tube, and a third wiper plug;

wherein:

the first burst tube adapted to burst at a pressure between 900 psi and 1100 psi;

the second burst tube adapted to burst at a pressure between 3500 psi and 5000 psi;

the first wiper plug is coupled to the second wiper plug by a shearable fastener, the shearable fastener adapted to shear at a pressure between 500 psi and 700 psi; and the second wiper plug is coupled to the third wiper plug by a shearable fastener, the shearable fastener adapted to shear at a pressure between 1300 psi and 1700 psi.

16. The work string of claim 8, wherein the one or more plugs are:

a first wiper plug including a first burst tube, a second wiper plug including a second burst tube, and a third wiper plug, wherein each of the first wiper plug, the second wiper plug, and the third wiper plug further include:

a finned seal;

a plug body;

a latch sleeve having a collet formed in an upper end thereof; and a lock sleeve having a seat and a seal bore formed therein, each lock sleeve movable between an upper position and lower position, the lock sleeve releasably restrained in the upper position by a shearable fastener, wherein the first burst tube is adapted to burst at a first pressure, and the second burst tube is adapted to burst at a second pressure greater than the first pressure.

17. The work string of claim 8, wherein the tieback casing string is coupled to the tieback deployment assembly via engagement of a bayonet lug.

18. A plug release system, comprising:

a first wiper plug including a first burst tube disposed directly over a first bypass port formed in a wall of the first wiper plug and configured to prevent fluid flow through the first bypass port, the first burst tube adapted to rupture at a first pressure, wherein rupturing of the first burst tube opens the first bypass port, thereby allowing fluid to travel through the first bypass port;

a second wiper plug including a second burst tube disposed directly over a second bypass port formed in a wall of the second wiper plug and configured to prevent fluid flow through the second bypass port, the second burst tube adapted to rupture at a second pressure greater than the first pressure, wherein rupturing of the second burst tube opens the second bypass port, thereby allowing fluid to travel through the second bypass port; and a third wiper plug;

wherein:

the first wiper plug is coupled to the second wiper plug by a first shearable fastener, the shearable first fastener adapted to shear at a third pressure; and the second wiper plug is coupled to the third wiper plug by a second shearable fastener, the second shearable fastener adapted to shear at a fourth pressure greater than the third pressure.

19. The plug release system of claim 18, wherein:

the first wiper plug further includes:

a first finned seal;

a first plug body; and a first latch sleeve having a first collet formed in an upper end thereof, wherein the first latch sleeve includes the first bypass port; and a first lock sleeve having a first seat and a first seal bore formed therein, the first lock sleeve movable between an upper position and lower position, the first lock sleeve releasably restrained in the upper position by the first shearable fastener;

the second wiper plug further includes:

a second finned seal;

a second plug body; and a second latch sleeve having a second collet formed in an upper end thereof, wherein second latch sleeve includes the second bypass port; and a second lock sleeve having a second seat and a second seal bore formed therein, the second lock sleeve movable between an upper position and lower position, the second lock sleeve releasably restrained in the upper position by the second shearable fastener;

the third wiper plug further includes:

a third finned seal;

a third plug body; and a third latch sleeve having a third collet formed in an upper end thereof; and a third lock sleeve having a third seat and a third seal bore formed therein, the third lock sleeve movable between an upper position and lower position, the third lock sleeve releasably restrained in the upper position by a third shearable fastener.

* * * * *